US008313102B1

(12) United States Patent
Thornton

(10) Patent No.: US 8,313,102 B1
(45) Date of Patent: Nov. 20, 2012

(54) CURRENT AFFAIR, POLITICAL GAME APPARATUS AND METHOD ENGAGING ROLE PLAY

(76) Inventor: Yolanda Gail Thornton, Lithonia, GA (US)

( * ) Notice: Subject to any disclaimer, the term of this patent is extended or adjusted under 35 U.S.C. 154(b) by 515 days.

(21) Appl. No.: 12/456,375

(22) Filed: Jun. 16, 2009

(51) Int. Cl.
*A63F 3/00* (2006.01)

(52) U.S. Cl. ..... 273/257; 273/243

(58) Field of Classification Search ..... 273/243, 273/257, 279
See application file for complete search history.

(56) References Cited

U.S. PATENT DOCUMENTS 3,545,762 A * 12/1970 Atkinson ..... 273/257
5,213,333 A * 5/1993 Petrovich et al. ..... 273/243
* cited by examiner

*Primary Examiner* — Vishu K. Mendiratta

(57) ABSTRACT

A board game apparatus and method for entertaining people by supporting unlimited numbers of participation. Players chose a political party then proceed by rolling dice to navigate the quadruple arch-shaped, color-coded, time-stamped, spaces on the game board. The spaces direct players to a plurality of cards explaining presidential decisions to be made after which players refer to one or more of three devices. Device one is reference material provided to aid players in developing confidence, leadership and public speaking skills. Device two calculates the impact on the Federal Budget and determines how many of player's proposed bills are passed through congress. Device three assist in a majority-minority voting technique to achieve impact on Approval Rating scores which feeds into players goal of acquiring the highest score. Players showcase their personal knowledge of politics and people skills to sway voter opinions.

12 Claims, 13 Drawing Sheets

FIGURE 5.1
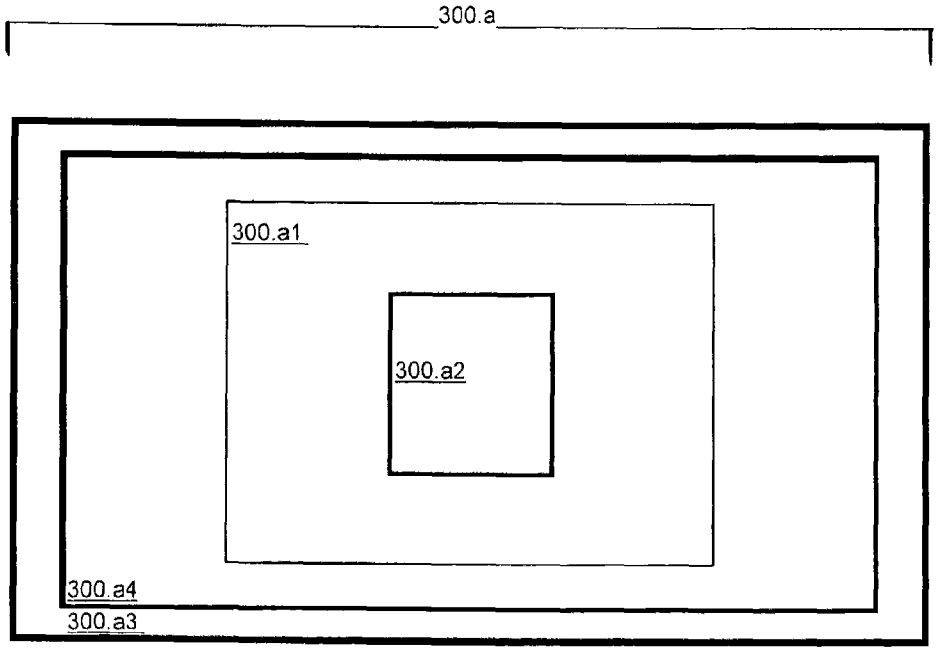

FIGURE 5.2a
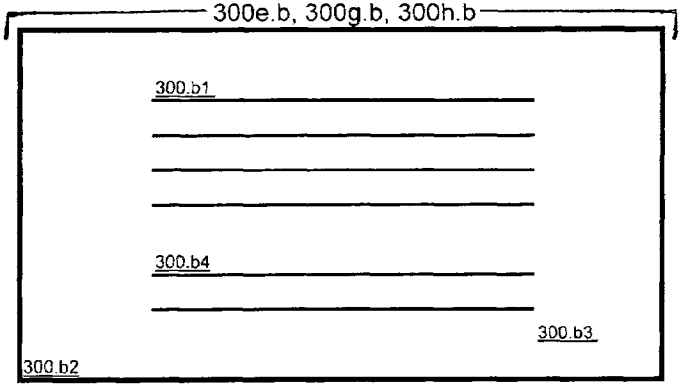
FIGURE 5.2b
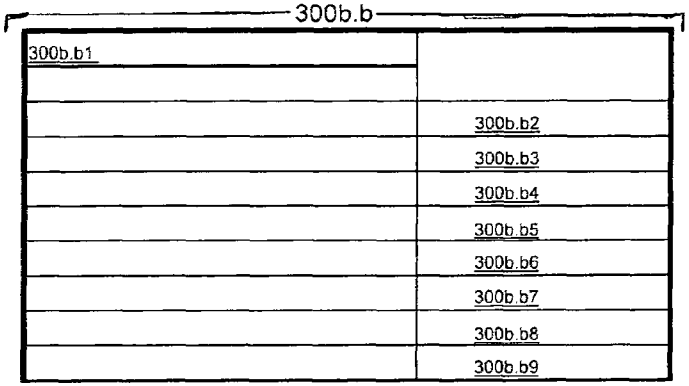
FIGURE 5.2c
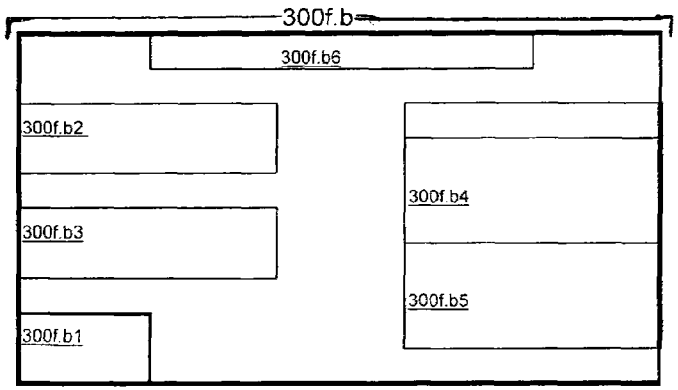
FIGURE 5.2d
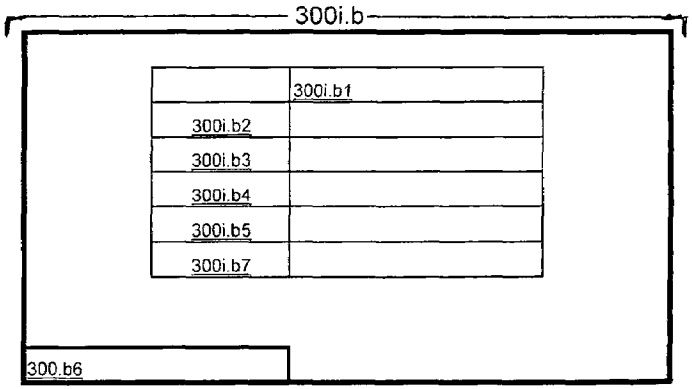

FIGURE 6.1
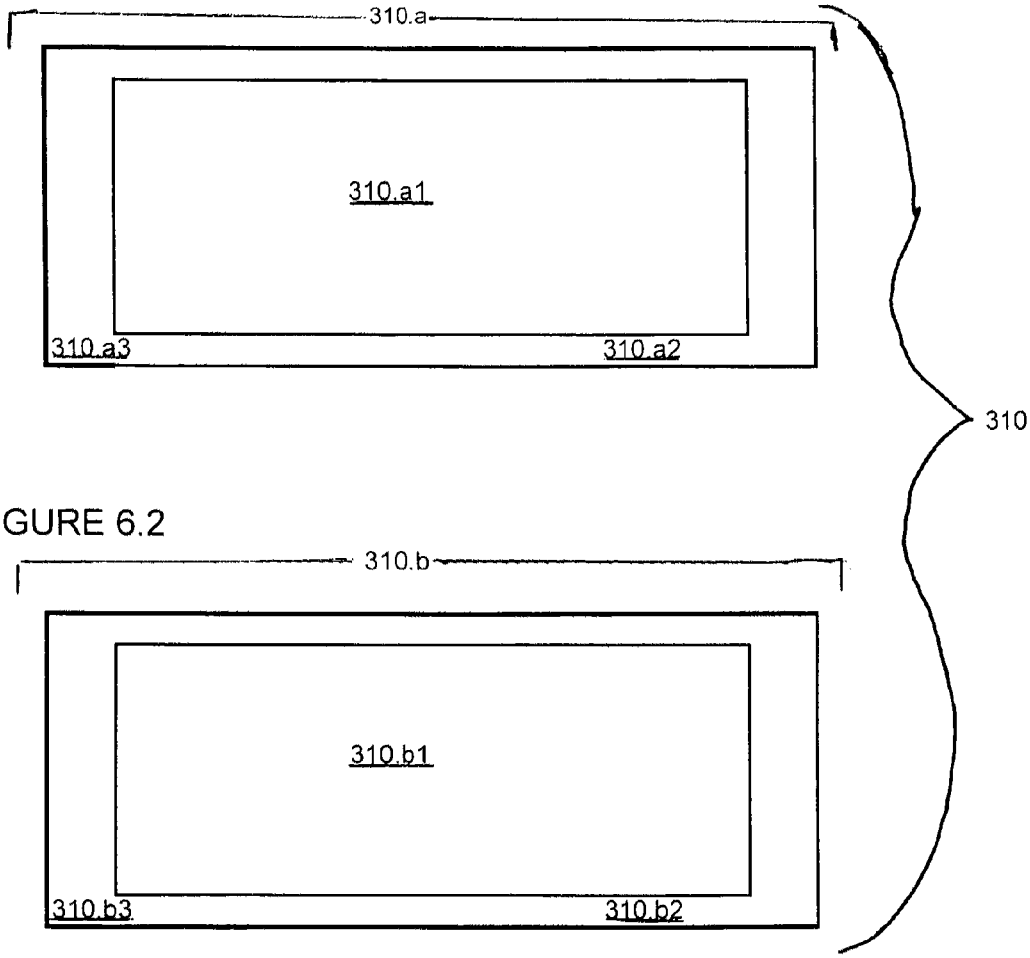
FIGURE 6.2

500

TOTAL NUMBER OF US TROOPS FIT FOR SERVICE

507

| WAR CARD NUMBER | NUMBER OF TROOPS DEPLOYED FOR WAR | REMAINING TROOPS AVAILABLE FOR SERVICE | OPPOSING COUNTRY OR GROUP | DURATION OF WAR | CHECK IF YOU ARE ELIGIBLE TO FILL OUT OF WAR |
|---|---|---|---|---|---|
| 501 | 502 | 503 | 504 | 505 | 506 |
| | | | | | |
| | | | | | |
| | | | | | |
| | | | | | |
| | | | | | |
| | | | | | |
| | | | | | |
| | | | | | |

NOTE: Cross a line through the row if you have EXITED of war.

FIGURE 7C

600

Country 601
Chief of State: 602
Capital: 611
Location: 603
Population: 605
Languages: 612
Religions: 606
GDP: 604
Currency: 607
Exchange Rate: 608
Exports/Export Partnerships: 610
Imports/Import Partnerships: 609

Military: 620
Manpower: 620a
Allies: 620b
Nuclear Abilities: 620c
Currently at War with: 620d

FIGURE 7D

900

| PLAYER INITIALS | PORK NUMBER | PORK ITEM DESCRIPTION | AR VALUE | FEDERAL BUDGET IMPACT |
|---|---|---|---|---|
| 910 | 911 | 912 | 913 | 914 |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |

CURRENT AFFAIR, POLITICAL GAME APPARATUS AND METHOD ENGAGING ROLE PLAY

FIELD OF THE INVENTION

An Educational Entertaining board game that uses Political issues to develop critical thinking, public speaking and humanitarian awareness.

BACKGROUND OF THE INVENTION

The present invention is composed of an entertainment apparatus and method entertaining a group of people and for developing useful human skills including but not limited to leadership, negotiating, critical thinking, public speaking abilities political knowledge. Most games have a platform based on vote accumulation. Voting is not actually done by the players. Vote results are predetermined in a plurality of cards thus the players are not required to make strategic decisions from engaging critical thinking skills. These games are void of subjectivity.

Typical political games have been developed with a platform based on vote accumulation, However players are not actually voting but merely following a process which predetermines vote results. For example U.S. Pat. No. 5,624,120 (issued on 29 Apr. 1997 to Frank-Opigo) involves only two players each seeking the majority electoral college votes. However neither of the two players actually vote. Another example of players failing to vote but voting is insinuated throughout game is disclosed in U.S. Pat. No. 5,288,076 (issued 22 Feb. 1994 to Jackson, et al). Other examples where votes are predetermined through the players rolling dice having faces marked with differing percentages of the popular vote to determine a win is in U.S. Pat. No. 5,374,066 (issued 20 Dec. 1994 to Ali) and Race for the White House. Likewise Hail to the Chief, achieves predetermined voting outcome by players drawing from a plurality of cards containing voting results. Until now prior political game art have only explored pre-election presidential campaigns which is omitting the entire four years of presidency. For Instance, U.S. Pat. D494635 (issued 7 Aug. 2004 to Wright although unique in nature in that the game captures the major real life personalities of the Florida 2000 presidential pre-election still it stopped short of exploring the intriguing four year term that followed.

Similarly U.S. patent (1960 Making of the President) extracted John F. Kennedy's real life Pre-election experience.

Murphy et al's political game art disclosed in U.S. Pat. No. 5,137,279 issued 11 Aug. 1992 also captured only pre-election activity which included an array of raw politics public opinion, press scrutiny and mudslinging.

Other politically based games which focus on the pre-election process of a US Presidential Campaign is disclosed in U.S. Pat. No. 5,660,390 (issued on 26 Aug. 1997 to Ginzburg et al) through its use of trivia to simulate presidential election facts. Also, U.S. Pat. No. 5,624,120 (issued 29 Apr. 1997 to Frank-Opigo), only features the pre-election period of a Presidency. Likewise both U.S. Pat. No. 5,288,076 (issued 22 Feb. 1994 to Jackson, et al.) which claims a realistic approach to Presidential election and U.S. Pat. No. 5,374,066 (issued 20 Dec. 1994 to Ali) emulates the steps leading to the Presidency but play stops once player achieves Presidency status.

A factor known in many political games is accessibility to current affair information. U.S. Pat. No. 7,007,952 (issued 7 Mar. 2006 to Plato) extracts Government, history and culture but no current affair events.

Another example of lack of current affair events is US patent "Hail to the Chief" focusing solely on US History, geography and constitutional law. Other examples whereby current affair events are lacking include U.S. Pat. No. 5,067,721 (issued 26 Nov. 1991 to Hart) which discloses trivia questions of only 40 terms of presidents.

Games were reactions to questions are predetermined voids any subjective in response are also prominent. Such games limit opportunities for critical thinking one example of loosed subjectivity and critical thinking skills is U.S. Pat. No. 6,139,016 (issued 31 Oct. 2000 to Plato) which discloses a scenario board game whereby players choose from a plurality of cards spelling out a brief situation design to evoke a reaction. However points are only gained by opposing players selecting one of four predetermined reactions. Subjectivity is limited to only one of four predetermined responses which in essence is neither sincere, spontaneous and more importantly has only limited subjectivity.

Player participation must be close by balanced U.S. Pat. No. 5,657,992 (issued August 1997 to Bellizzi) discloses a role playing game whereby only one player acts as the dominate role of director, instead if a shared or alternating responsibility this style of play reveals lulls of activities experienced by the other players.

Also (Bellizzi, 992) offer little substantive value to the roles which the players are playing instead of acting out non existent characters in mediocre situations. Players are not engaging their critical thinking skills and ideas which lead to actions that could benefit the human race.

Also none of the prior art games has developed pays attention and detail to an array or multiple aspects simultaneously. Up until now prior art has only developed one aspect of political process it election, history, civil government a specific events etc. For instance, U.S. Pat. No. 5,443,268 (issued 22 Aug. 1995 to Ali) discloses US strategies and support through a multiple level board complete with surface missiles, submarines destroyers tanks cannons, bombers, fighter planes, aircraft carriers, a patriot, soldiers, generals, president, and congress. US Defense is its only focus. Another such instance is a Nuke awareness game under U.S. Pat. No. 4,560,170 (issued 24 Dec. 1985 to Enyi) whereby Enyi narrows the scope of president administration to just nuclear awareness.

SUMMARY OF THE INVENTION

In view of the foregoing background, it is the aim of the present invention to go beyond the traditional voting simulation concepts, historical events, pre-election season, forced response reactions inconsistent player involvement, role playing of shallow characters, and limited scopes settings of reality all of which are the common place of the prior political game art. The present invention conquers this aim through its highly developed apparatus and method that offers authentic voting processing, frequent periodic current affair updating, strategic decisions generated by critical and subjective thinking, consistent high levels of all-players participation, enlightening leadership role playing and an array of presidential perspectives.

The preferred embodiment of the present invention creatively extracts the decision making element from the presidency, and balances that process with entertainment, which allows players to explore an array of current Presidential experiences. These experiences include but are not limited to Foreign Affairs, Homeland Security, National Defense and War Policies, Policy Making and Federal Spending, Natural Disaster Policy, Press Conferences, Supreme Court Justice Selection, State of the Union Address and Congressional Hearings. Although there are other significant aspects that surround and supports the Presidency such as the Cabinet members, the White House Executive Staff, Members of Congress, and the Supreme Court, however it is the belief that the very essence of the role of the Presidency is captured in the decision making component. The preferred embodiment of the present invention enables players to become President of their own United States of America thus both players' political knowledge and understanding of important information about the current state of America and other world economies is challenged and strengthened.

Another very important aspect that the present invention offers is the ability to accommodate unlimited numbers of participants in addition to the recommended four to eight core players. This feature adds a far more realistic approach than any of the foregoing prior art because core players are constantly concerned about the opinion of the public, the Approval Rating, one tool by which the players' performance is measured. The preferred embodiment of the apparatus and method enables unlimited numbers of non-core players also known as outside bystanders to participate and contribute on a very rewarding level of play. Players must utilize their public speaking skills, quick response skills, negotiation skills, critical thinking skills, and collaborating skills to sway and win the opinion the ruling majority voters.

The preferred embodiment of the present invention also enables players performance to be measured empirically through player's strategic decision making and critical thinking on policy making. Players compete for government programs that has the most profound effect on the country's economy which ultimately has a positive net affect to the federal budget. Yet another tool by which the players performance is measured. Through the use of frequent updating current affair measures players are developing life skills that benefits both the players and others. Critical thinking skills and strategic decision making skills are being engaged to solve actual real world problems in collaboration with others who are also engaging their critical thinking and strategic decision making skills.

In one preferred embodiment of the present invention a method of playing a game comprises a first player rolling two dice and advancing a player placeholder along a movement track based on total number rolled on dice. The movement track comprises of four consecutive, connecting color coded arches, each arch corresponding to one year of a president's four-year term. Each arch of the track comprises of 36 spaces bearing indicia reflecting political topics some of which corresponding to a plurality of decks of a plurality of cards or other political scenario options.

The preferred embodiment apparatus and method comprises the first player landing on either a plurality of current affair situation spaces which corresponds to a specific deck of plurality of current affair situation cards containing a politically charged problem or landing on a plurality of space each featuring a unique aspect to the Presidency that may or may not increase or decrease the Federal Budget and is broken down individually at the end of the Detailed Description of the Invention in the section A of the Preferred Embodiment.

If the first player lands on a current affair situation space then the method further comprises the first player proffering a critically thought out strategic decision to the selected situation card.

The method further comprises assigning a number of points to the first player which is a subjective evaluation of the first players performance from all other players and participants.

DESCRIPTION OF THE DRAWINGS

The details of the present invention are best understood by reference to the following detailed description when read in conjunction with the drawings, wherein:

FIG. 5.1 are the detailed plan view of the front side 300.*a* of the scenario cards.

FIGS. 5.2*a*, 5.2*b*, 5.2*c*, and 5.2*d* illustrates plan view of four unique reverse sides 300.*b* of the scenario cards.

FIGS. 6.1 and 6.2 are the detailed plan view of both the front side 310.*a* and reverse side 310.*b* of the Voting Paddle 310.

FIG. 7C illustrates the FARP. The writing on the drawing is strictly for visual impact only and is in no way descriptive.

FIG. 7D illustrates The President's Pork List. The writing on the drawing is strictly for visual impact only and is in no way descriptive.

DETAILED DESCRIPTION OF THE INVENTION

The present invention description can be best understood herein after in conjunction with reference to the accompanying drawings and appendix in which a preferred embodiment of the invention is shown This invention may, however, be embodied in many different forms and should not be construed as limited to the embodiment set forth herein. Rather this embodiment is provided so that this application will be thorough and complete and willfully convey the true scope of the invention to those skilled in the art.

I. Preferred Embodiment

A. Apparatus

Figure 1:
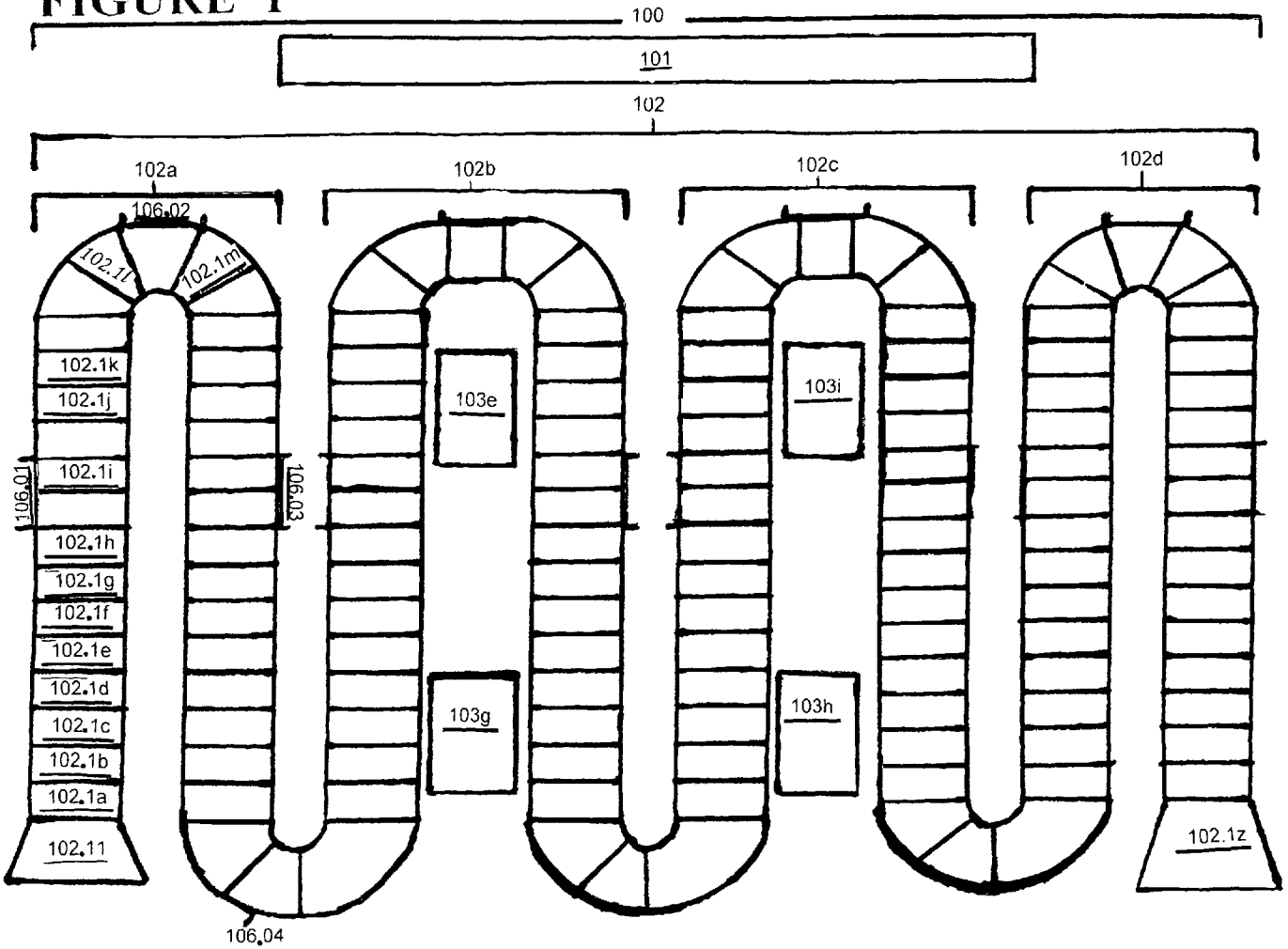
FIG. 1 is a plan view of the preferred embodiment of a board for playing a game in accordance with this invention.

A preferred embodiment can be illustrated by FIG. 1 and is generally referenced as number 1.0. As embodied herein and referring to FIG. 1, a game board 100 includes a playing surface100.*a*. Imprinted on the playing surface 100.*a*, is a movement track 102, comprised of four consecutive, connecting symmetrical time-stamped color coded arches102(*a-d*), Each arch corresponds to one year of a United States president's four year term. Each arch102(*a-d*), of the movement track102, comprises of 36 spaces. The 36 spaces of the movement track comprises of thirteen unique indicia bearing spaces. All the spaces with an exception of one, the Inaugural Address 102.1*a*, reoccur repeatedly throughout each of the four arches of the movement track. Unique indicia bearing on four of the spaces "Foreign Affairs"102.1*e*, "Domestic Affairs" 102.1*g*, "Media Frenzy"102.1*h*, and "War" 102.1*i*, of the movement track 102, of the preferred embodiment of the present invention are matched to four sets of a plurality of decks of cards 300*e*, 300*g*, 300*h*, and 300*i*, bearing initials of the four spaces 102.1*e*, 102.1*g*, 102.1*h*, 102.1*i*. The front side 300.*a*, of these plurality of decks of cards 300*e*, 300*g*, 300*h*, and 300*i*, comprises a proposed game trademark 300.*a*1; title 300.*a*2 and a border300.*a*3. The cards reverse side 300.*b*, bears a unique scenario numeric identifier300.*b*2; a game edition300.*b*3; the verbiage explaining a specific politically based scenario 300.*b*1; and subjective questions 300.*b*4. More specifically the four sets of plurality of cards FA300*e*, DA300*g*, MF300*h*, and War300*i* are defined as follows:

[Note: For convenience hereafter, on any turn of a game, a player whose turn it is will be referred to as the current president, and the other players will assume multiple roles of either constituents or members of the White House press corps or congress, according to space of the pawn of the current president.]

"Foreign Affairs" symbolized by FA300*e*.*a*2, and is illustrated with foreign nation flags300*e*.*a*1. Subjective questions and situations300*e*.*b*1, derived from recent political activities that takes place on foreign soil or overseas, including interactions with leaders of other countries. Players may refer to the FARP 600, which is further detailed in the present inventions preferred embodiments accompanying literature section of the detailed description.

"Domestic Affairs" is symbolized by DA300*g*.*a*2, and is illustrated with the hippo speaking from behind a podium300*g*.*a*1. Subjective questions300*g*.*b*4, and situations300*g*.*b*1, derived from recent political activities that takes place within the boundaries the United States of America. More specifically but not limited to questions with topics including Economy, Healthcare, Homeland Security, Alternative Energy, Military, Education, Employment, Legislative Branch, Pork Elimination and Natural Disasters.

"Media Frenzy" symbolized by MF 300*h*.*a*2, and is illustrated by a giraffe speaking from behind a podium300*h*.*a*1, expresses subjective questions300*h*.*b*4, and scenarios300*h*.*b*1, derived from both planned and unplanned political incidents that attracts flurries of media attention. Such attention includes but are not limited to scandals, press releases, press conferences, and appearances.

The set of plurality of cards bearing the indicia War 300*i*.*a*2, and is illustrated with an army tank 300*i*.*a*1, comprises of components to real life war conflicts or simulated potential war conflicts between the United States and either foreign nations or hostile groups300*i*.*b*1.

The same unique indicia bearing on the four spaces102.1*e*, 102.1*g*, 102.1*h*, 102.1*i*, of the preferred embodiment of the present invention also represents and is bearing on four place settings 103*e*,103*g*,103*h*,103*i* on the playing surface100.*a*, of the game board 100.

The two spaces 102.1*b* and War 102.11 have been strategically placed on the movement track 102 at the time markings 106 and correlates with time in quarters of years on the Cards 300*b*, 300*i* and the Oval Office200.

The preferred embodiment defines the themes expressed in unique indicia bearing on selected spaces of the movement track 102, the plurality of sets of cards 300(*e,g,h,i*), and the place setting 103(*e,g,h,i*), for the plurality of sets of cards 300(*e,g,h,i*), are presented for illustration only and are not intended to limit either the scope or variety of the potential themes for the current game.

Another set of plurality of cards is platform programs 300*b*, is introduced by a fifth unique space of the thirteen unique spaces 102.10 imprinted on the movement track102 of the preferred embodiment is "Policy Making" 102.1*b*, which connects a player to a plurality cards bearing unique indicia defined as "Platform Programs," 300.*a*2. "Platform Programs" cards300*b*, are time sensitive cards which line up with time markers106, on the playing surface100.*a*, of the game board100. The space "Policy Making" 102.1*b*, is strategically placed at the time markers 106 on the movement track 102 and gives the current president a chance to strategize how they will shape the current president's administration, through their selection of one card out of the set of plurality of cards entitled Platform Programs300*b*. The Platform Program cards300*b*, comprises of components of simulated real life strategies that policy makers may implement to eliminate or reduce chronic issues which plague the country. More specifically the components of a platform card300*b* are 300*b*.*b* (1-9).

Another feature for the unique space "Policy Making"102.1*b* on the movement track 102, of the preferred embodiment is the option to exit a war or multiple wars.

Another set of plurality of cards included in the preferred embodiment bears the unique indicia" "Party Ratio"300*f*.*a*2. The Party Ratio cards300*f* reveal the Party makeup percentages for both the House of Representatives300*f*.*b*3, and the Senate300*f*.*b*2 of the US Congress. The first current president selects one Party Ratio card 300*f* to determine party ratios for all players in game.

As mentioned earlier in the detailed description of the preferred embodiment of the present invention includes the first space of the movement track102, and is labeled and defined as "Inaugural Address"102.1*a*, which prompts the First President only to give a brief address on what he or she intends to do as President. The First President should address the nation as "My Fellow Americans . . . " Because it is the first space, it is statistically impossible for any other players to land here using two dice.

"Vacation"102.1*c* which allows the current president to rest and reflect on the presidency.

"Deduct Pork"102.1*d* instructs the current president to take the Federal Budget Impact 915, and AR value 914, of the next available line item from the President's Pork List 900, and enter into the column labeled Change in Federal Budget 452 as an addition to the Federal Budget Log 450, section, and the column labeled AR Change 481 as an addition to the AR 480 section of the President's Personal Log 400.

Likewise, "Add Pork 102.1*j*, instructs the current president to take the Federal Budget Impact 915, and AR value 914, of the next available line item from the President's Pork List 900, and enter into the column labeled Change in Federal Budget 452 as an deduction to the Federal Budget Log 450, section, and the column labeled AR Change 481 as a deduction to the AR 480 section of the President's Personal Log 400.

"Submit 10/20/30 Bills to Congress"102.1*f* guides the current president to the Oval Office Party Ratio Table 250. To determine the number of bills passed in Congress which transforms into an Approval Rating Value entry 481, for the President's Personal Log's 400, Approval Rating Section 481.

"Press Conference", 102.1*k*, prompts the current president to select two other players, now role playing as "White House Press reporters, to ask current president a question. The current president answers two questions, in a specified time period. The White House Press Reporters then vote on the performance of the current president. The vote is tallied according to the Voting Key 490, of the PPL 400, and then the resulting AR value is doubled to become the Press Score and entered into the AR Change column 481 of the AR section 480 of the President's Personal Log 400.

"Appoint Judge to the Supreme Court" 102.1*l*, prompts a player to take 30 seconds to explain why he appointed a specific judge to the Supreme Court, after which the other players become the Senate. The Senate must attempt to confirm the appointment with a majority vote. The vote accomplishes two task: 1) It either confirms or rejects the current president's appointment. 2) The vote translates into an AR score value to be entered into AR Change column 481, of section 480 of the President's Personal Log 400.

The last of the unique repeating thirteen spaces in the preferred embodiment of the present invention's playing surface, 100*.a* is "State Of The Union Address"102.1*m*, in which the current president lands on this space must take 30 to 90 seconds according to a pre-chosen time piece 751, 752, or 753, to briefly address to the constituents. The current president uses information from the Personal Presidents Log 400, as a resource of material on which to speak. The constituents must then vote. The vote is tallied according to the Voting Key 490, of the PPL 400, and then the resulting AR value is doubled to become the Press Score and entered into the AR Change column 481 of the AR section 480 of the President's Personal Log 400.

Figure 2A:
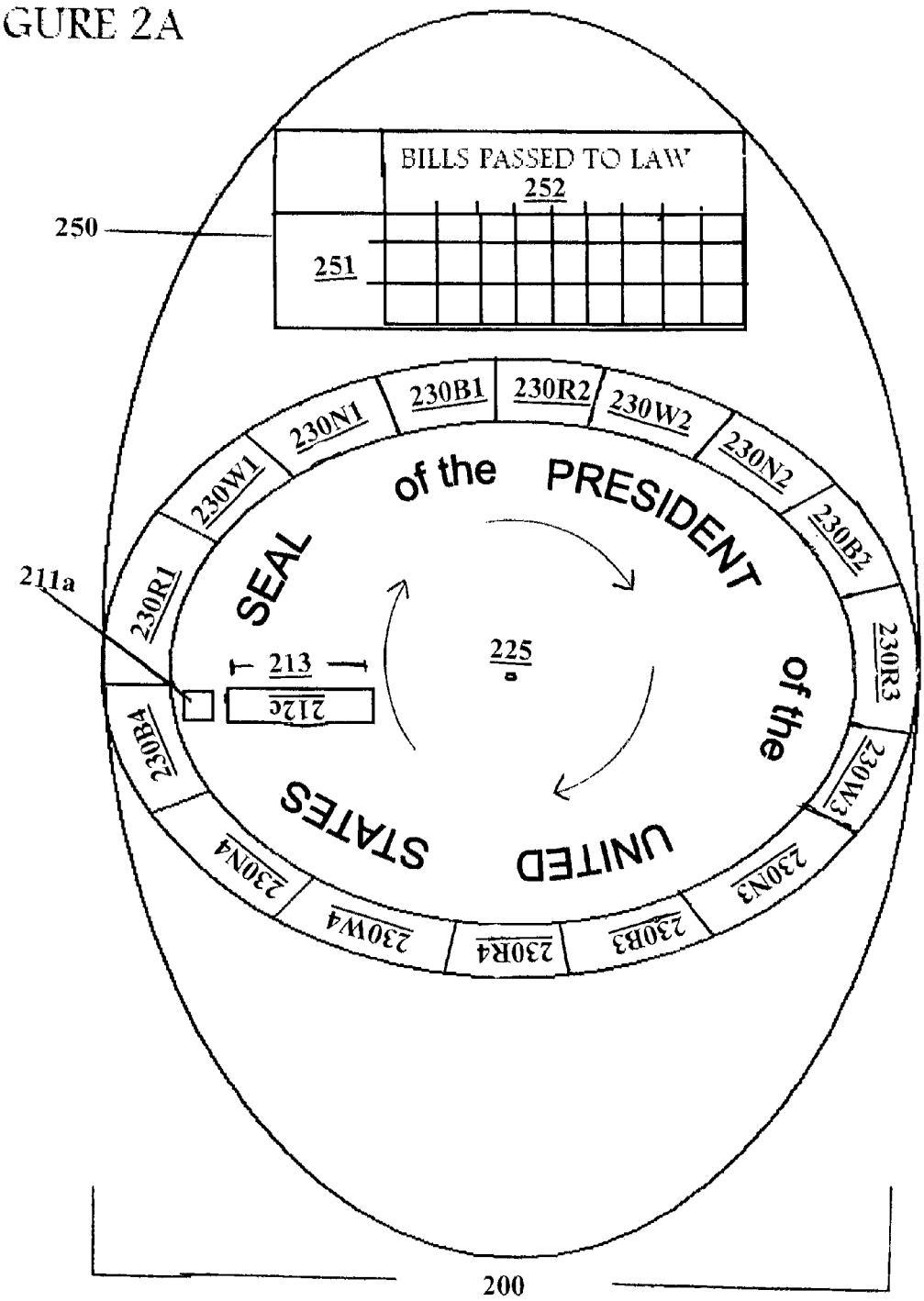
FIG. 2A illustrates the plan view of the complete device referred to as the Oval Office 200 including details of the Bills Passed to Law Ratio table 250. The writing on the drawing is strictly for visual impact only and is in no way descriptive.
Figure 2B:
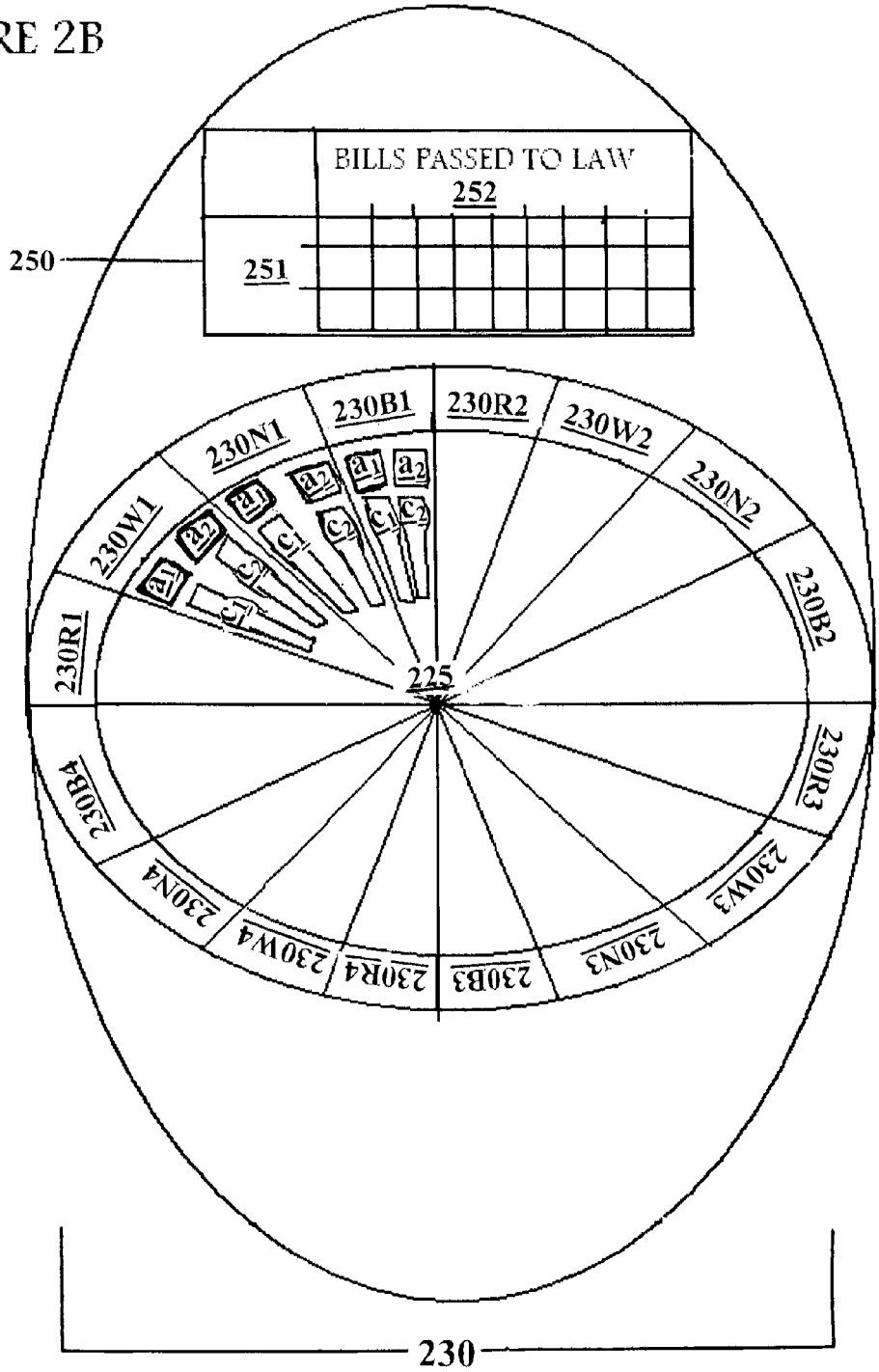
FIG. 2B illustrates the plan view of the bottom panel 230 of the Oval Office 200. The top panel 210 has been removed thus exposing pie shapes. Each pie shape is divided into four subsections of data referred to and labeled as $a_1$, $c_1$, $a_2$, $c_2$. The data $a_1$, $c_1$, $a_2$, $c_2$ is viewed through top panel 210 windows 211*a* and 212*c* as shown in FIG. 2C. The writing on the drawing is strictly for visual impact only and is in no way descriptive.
Figure 2C:
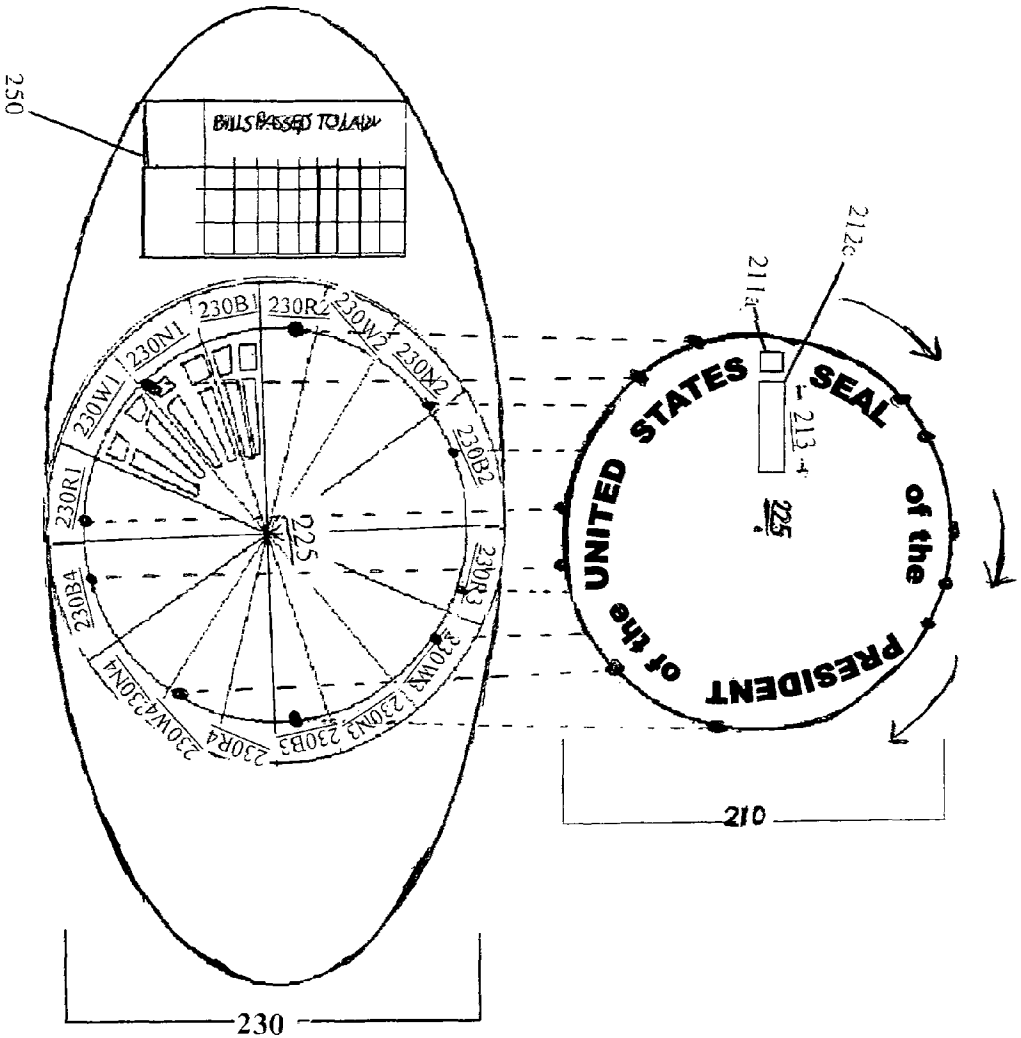
FIG. 2C illustrates how both components, top panel 210 and bottom panel 230, connect at its vertex 225 and function as one unit. The context of the inner circle of the bottom panel is hidden. The writing on the drawing is strictly for visual impact only and is in no way descriptive.
Figure 3A:
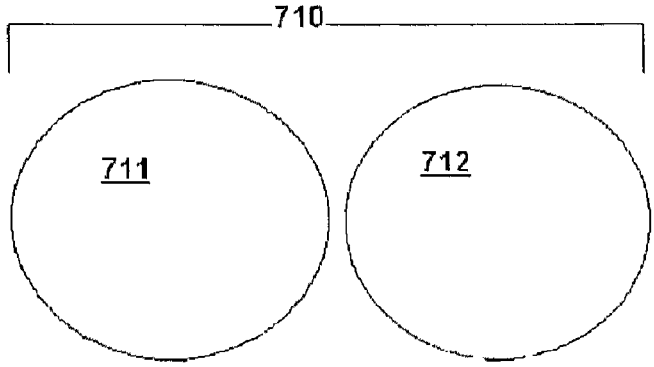
FIGS. 3A and 3B illustrates the plan view of the Political Party buttons 710, the Leader Token 720, and the War Chips 76.
Figure 3B:
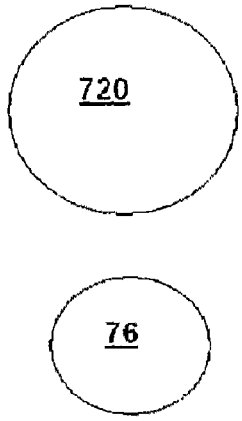
Figure 4:
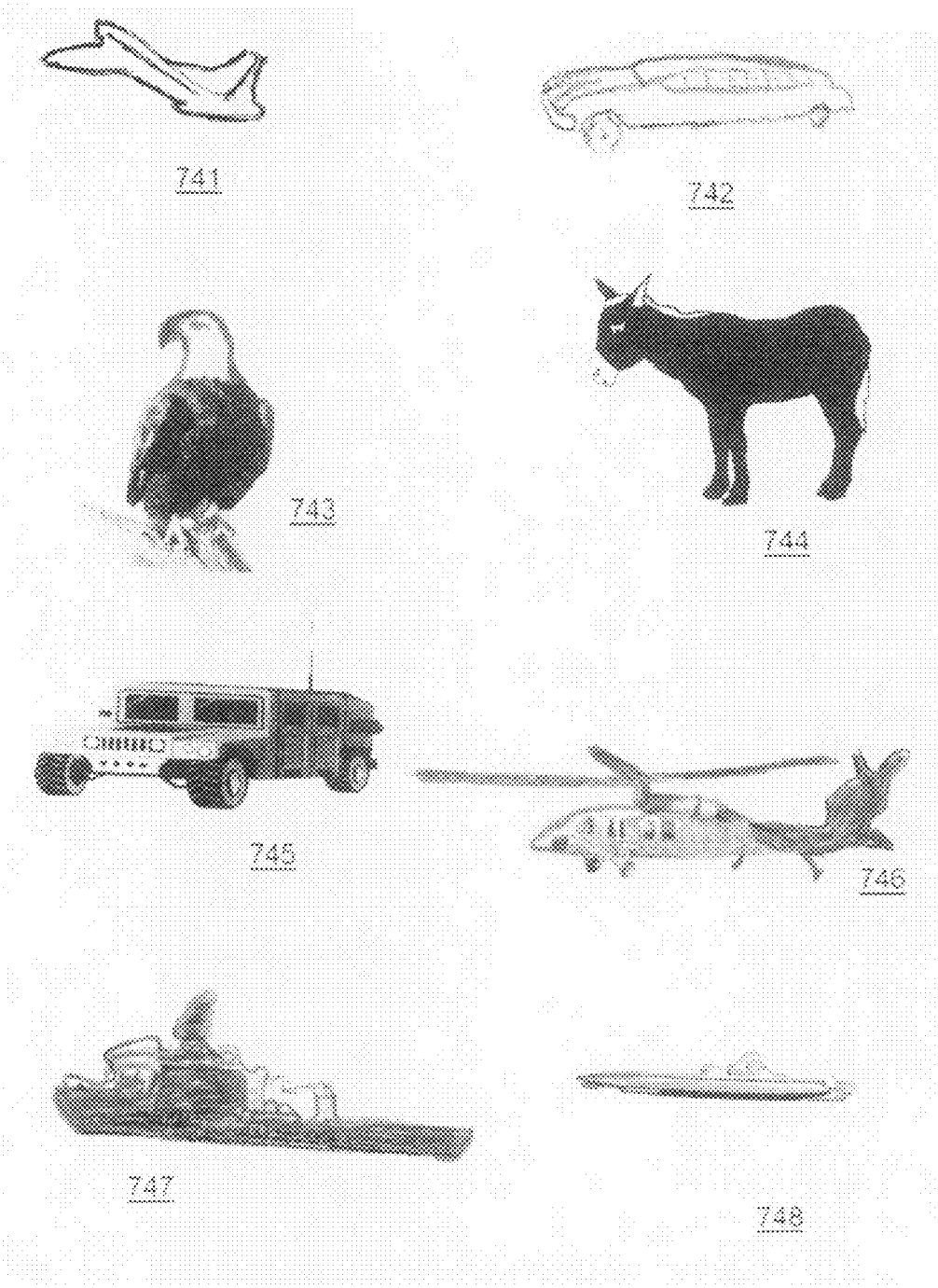
FIG. 4 illustrates the shapes of the eight place markers referred to as pawns 741-748.

Additionally the preferred embodiment of the present invention comprises the Oval Office 200, and is illustrated in FIGS. 2A, 2B and 2C. The current president refers to the "Oval Office" 200, to calculate the impact selected platform programs300*b*, have on the federal budget 450. As shown in FIGS. 2A-2C, the Oval Office comprises of a circular top panel and a bottom oval shaped panel 230, with a circle shape inlayed at its center slightly larger than the circular shape top panel 210. The top panel 210 overlaps directly on top of the bottom panel 230 meeting and attached at the vertex 225 of both panels. The top panel 210 rotates over the bottom panel. The top panel 210 bears indicia of a presidential seal as well as comprises of two windows 211*a* and 212*c*. The First window 211, is the smaller of the two and through it can be seen specific Payment Frequency information 211*a* from the underlying bottom panel 230.

The $2^{nd}$ window 212*c* is longer than the first window 211*a*. Along side the $2^{nd}$ window 212*c*, and on the face of this top circular panel 210 of the Oval Office200, is the consecutive payment scale 213 comprising of numbers from 10 to 100. The Consecutive Payment scale 213 signifies the amount of each individual payment that a potential platform program could make back to the Federal Government. The Consecutive Payment Window 212*c* when properly aligned to bottom panel 230 reveals the total amount $c_1$ and $c_2$ any given platform program 300*b*, will pay into the Federal Government for the remainder of the player's presidential term. The bottom panel 230, as shown in FIG. 2B, comprises of four sections distinguished by time in months representing quarters of a year as follows; 3 months 01, 6 months 02, 9 months 03, and 12 months 04. Each quarter year has four subsequent sections distinguishable by years of a four year presidential term. The four years are color coded and quartered as follows; Year1Red is R1,R2,R3,R4 or R[1-4]; Year2White is W[1-4]; Year3Navy is N[1-4]; and Year4Black is B[1-4]. Each year has two subsequent sections $a_1$ or $a_2$, representing two possible Payment Frequencies (either 3 months, $a_1$, or 6 months $a_2$) with which a platform program 300*b*, may make periodic payments to the Federal Government. Corresponding to the two possible frequencies $a_1$ and $a_2$ are two sets of numbers $c_1$ and $c_2$ which also line up with the payment scale 213 on FIG. 2A and represent the exact amount of total revenues that have been paid into the federal budget for the remainder of the duration of the current president's presidential term. Items $c_1$ and $c_2$ are viewed through window 212*c*.

Also illustrated in FIG. 2A. the preferred embodiment of the present invention Oval Office 200 also comprises a Party Ratio Table 250. The Party Ratio Table when properly applied, determines how many bills submitted to congress becomes law 253.

The preferred embodiment of the present invention comprises eight game board place markers hereinafter referred to as pawns. The pawns 740, bear a plurality of unique shapes but they all are of one single color. The Pawns represents presidential themes including a multitude of ways in which a president travels and are shaped in the following likenesses: Air Force One Jet Plane 741, Cadillac limousine 742, Helicopter 746, Submarine 748, US Cruise Liner 747, Hummer 745, Mule 744 and Eagle 743.

The preferred embodiment of the present invention comprises a method for voting which includes but not limited to a voting paddle 310, A voting paddle 310, is an apparatus used to rate the performance of the current president. Constituents must vote on the current president in one of two ways, either fist bump for approval 310*a*, or duck310*b*, which expresses disapproval. Only one opinion is expressed at a time. Constituents express their individual opinions by holding up the apparatus with the desired opinion side facing the other players. Thus the non desired side is hidden from plain sight.

If a voting paddle 310 is not assessable, the preferred embodiment of the present invention accommodates an alternative voting technique through the use of hand gestures. The constituent may do a "fist bump" with the current president or a "thumbs up" to express approval. To express disapproval the constituent can do a "thumbs down" hand gesture.

The present invention preferred embodiment applies a technique that focuses on the make of the total vote count and not the total number of counts itself. More specifically the present invention implements a Majority/Minority/Unanimous system titled Voting Key 490. This preferred embodiment enables unlimited numbers of voters also known as constituents to participate. More specifically a current president receives the highest score of four points if constituents unanimously approve 491, the current president's performance. Likewise the current president receives the lowest possible score minus four points if voters unanimously disapprove 495, the current president' performance. Similarly the current president receives the second highest score of 3 points if the majority of constituent approve 492. Likewise the current president receives the second lowest score of one point if the majority of the constituents disapprove 494, and two points if the constituents are tied 493.

Another defined unique indicia theme of a selected space of the movement track 102 of the preferred embodiment which also has a matching set of a plurality of cards300*i*, and place setting 103*i*, on the board's surface 100.*a*, is War.

Each War card 300*i.b* details components to a specific war and includes a time element called the "duration of the War"300*i.b*5. War Chips76 are used to mark the end of the War duration period 300*i.b*5. The current president logs all details of war cards 300*i.b*on the War Sheet 500 and PPL 400 which includes adjusting AR 481, FB 452, and Troop count 503. The War Chip 76 signifies the time at which the current president is eligible to exit the war. However, the current president's pawn 740 must land on Policy Making 102.1*b* to actually exit the war.

Figure 7A:
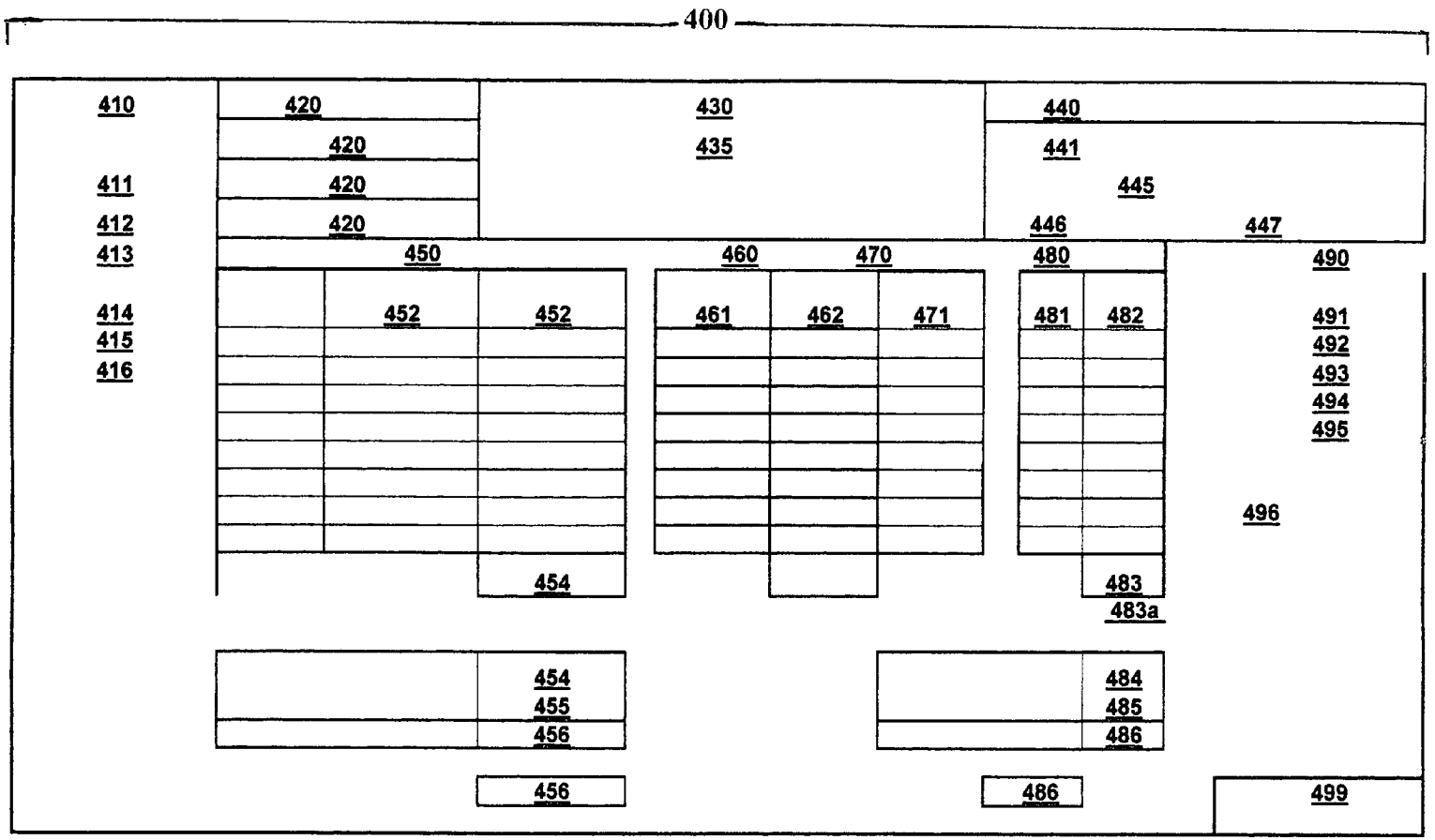
FIG. 7A illustrates the President's Personal Log. The writing on the drawing is strictly for visual impact only and is in no way descriptive.
Figure 7B:
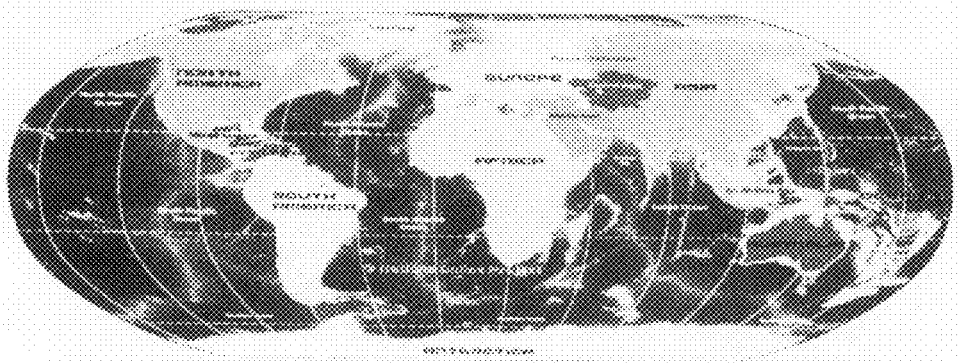
FIG. 7B illustrates the War Sheet. The writing on the drawing is strictly for visual impact only and is in no way descriptive.

The preferred embodiment includes 100 War Chips 76, evenly divided into four colors representing each arch of the movement track102(*a-d*). More specifically there are 25 red War Chips76R, 25 white War Chips76W, 25 navy War Chips 76N and 25 Black War Chips 76B. Each color represents one year of a four year presidential term. More specifically, red is year one white is year two, blue is year three, and black is year four. More specifically, each year is divided into four quarters and are reflected on the chips as 3 month red War Chips 76R1, 6 month red War Chips 76R2, 9 month red War Chips76R3, and 12 month red War Chips76R4; 3 month white War Chips76W1, 6 month white War Chips76W2, 9 month white War Chips76W3, 12 month white War Chips76W4; 3 month navy War Chips76N1, 6 month navy War Chips76N2, 9 month navy War Chips76N3, 12 month navy War Chips76N4; 3 month black War Chips76B1, 6 month black War Chips76B2, 9 month black War Chips76B3, and 12 month black War Chips76B4. Collectively illustrated in FIG. 7. Player logs details of War Card300I.b, onto War Sheet 500. The War Sheet 500 is described in the accompanying literature section of the detailed description of the preferred embodiment.

If a player possess one or more war chips 76 at the end of the game, then player is penalized a 15-point War deduction 483*a* from the Approval Rating 483 for each war chip 76 in that player's possession.

War Chips 76, also serves as a visual aid to alerts players when someone is actively involved in war. The visual aid is further helpful to players when a player in possession of war chip 76, referred to as "Player WC", lands on the Press Conference space 102.1*k* When Player WC land on Press Conference space 102.1*k*, Player WC must randomly select another player, Player2, to ask Player WC a question. Player2 may or may not choose to ask Player WC a question involving the details of the war in which Player WC is involved. Player WC must attempt to respond to the question which Player WC must respond in a specified time period 30 seconds 751/60 seconds 752/or 90 seconds753.

B. Accompanying Literature

The preferred embodiment includes the following literal devices which are essential to the flow of the apparatus. Such material includes the Foreign Affairs Reference Pack, FARP 600; The Presidential Pork List tablet 900, the President's Personal Log 400 and the War Sheet 500.

The FARP 600 corresponds with both the Foreign Affair space102.1*e*, of the movement tract 102, on the board's surface 100.*a*, as well as the FA Cards 300*e*, that are located on the FA place setting 103*e* on the board surface102. The FARP 600, is may be used to aid the current presidents and constituents with helpful recent and historical factual information about various countries 601 including but not limited to the name and title of a foreign country's leader 602, the Capital 611, the Geographical Location 603, the population 605, the language 610, religion 606, Gross Domestic Product 604, Currency 607 and Exchange Rate 608, Export/Import goods and partnerships 609, Military branches and known Nuclear abilities 620. More specifically, current presidents may need information when they are about to engage in negotiations with leaders of foreign countries, who is another player, in the game who also may need to draw from the FARP. The FARP 600, also houses brief factual information on Alternative Energy 650 options for those looking for questions to prepare for Press Conferences 102.1*k* and still others may be looking for material substance on which they can prepare a State of the Union Address 102.1*m*.

Additionally the FARP 600, comprises of brief details of Nuclear Weapon 640 information for those who find themselves addressing conflicts between countries who have nuclear capabilities to consider.

The President's Pork List tablet 900, comprises a randomly sorted items of real US Federal Government Pork barrel and ear marks 912, which the United State senators and House Representatives have introduced through Congress. The items on the list are the same on each page of the tablet, however the items have been randomly sorted. Fields included on the tablet are the current president's initials 910 which allows tracking of player ownership of the pork, 912. The present invention comprises the AR 914, value and the Federal Budget Impact 915 which represents the dollar value of each pork item listed. The dollar values have been augmented to better reflect game relevancy.

The President's Personal Log,[PPL], 400, comprises of all the necessary empirical data the player needs to track progress of the player's efforts. There are several PPL options each option representing a unique presidential Inheritance scenario and thus are pre-filled to reflect a specific United States President's Inheritance 430.[1-5] scenario. More specifically there is a pre-filled President Obama Inheritance PPL430.1, a pre-filled President Bush Inheritance PPL 430.2, a pre-filled President Clinton PPL 430.3, a pre-filled President Reagan Inheritance PPL 430.4 and a pre-filled President Carter PPL 430.5. During play, all players are restricted to the same President's Inheritance scenario in order that fairness is achieved through a homogeneous start.

The PPL 400, measures the progress and final outcomes in competition with other players. The PPL comprises Platform Subjects 410 of which each player chooses three on which their presidential campaign was run during the pre-election period. The PPL 400 also comprises Political Party Affiliation information 440 as will as the Percentage Makeup of the parties in Congress 445. Which will be used to determine how many bills will pass through Congress under each player's presidential administration. The PPL 400, also comprises of Federal Budget Log Information 450, Jobs and Unemployment 460, and Approval Rating Scores, AR 480. Lastly the PPL 400, simplifies the Final Score 499 at the bottom of the Log by merging the Federal Budget 450 with the War 483*a* and AR 480.

The War Sheet, 500 is an extension of the PPL400 and comprises of the unique indicia bearing a table of fields of the components of war. More specifically the fields include but are not limited to the War cards unique identification number 501, Number of Troops Deployed for War 502, The Remaining Troops Available for Service 503, The Opposing Country or Group 504 and The Duration of the War 505. The War Sheet 500 is also pre-filled to reflect the Inherited Wars of Previous Presidents 430.[1-5] of the United States.

Appendix A is a five-page cataloged list of all the ingredients and referenced numbers for the present invention.

II. Preferred Method

The object of the present invention is to entertain groups of people while teaching political concepts, promoting good citizenship, enhancing critical thinking abilities, developing public speaking skills. To achieve this goal players engage the following method of play.

The preferred method of the present invention commences with four to eight players sitting around a game board 100 from hence forth the game board 100 is referred to as the board. The board's playing surface 100.*a*, is set up by placing a plurality of sets of cards 300*e*, 300*g*, 300*h*, and 300*i*, on their corresponding place settings 103*e*, 103*g*, 103*h*, 103*i*, on the board's playing surface 100.*a*. Each player chooses from one of two political parties 441, or 442, by visibly attaching to their body a political party button 711, 712 bearing the corresponding political party indicia. Next players select a pawn 740 and places it on the start here area 102.11 of the movement track 102. Subsequently, each player takes one voting paddle 310 lies it flat down within reach. Additionally three players volunteer to be individually responsible for the following three different roles; Role One—the Chief of Staff which holds and administers the President's Pork List 900,; Role Two—the Secretary of Defense which holds and administers the War Chips 76,; and Role Three—the Secretary of State who holds and administers the FARP 600.

And Lastly a fourth Role is that of the "The First President" which is chosen by the highest roll of the two die 730 of all players. The First President has multiple initial duties including selecting an Inheritance 430 which is reflected on a pre-filled Presidents Personal Log 400 and War Sheet 500 and distributed to each player; selecting one Party Ratio card 300*f* from the pre-shuffled deck of a plurality of cards bearing Party Ratio indicia and reading the party ratio information 300*f*.*b* aloud for all players to record in the corresponding Party Ratio Section 440 of their President's Personal Logs 400; awarding the Leadership Token 720, to the person on the left of the First President; Placing the First President's pawn 740 on the first space 102.1*a* of the board which is labeled Inaugural Address and promptly giving a 60 second 752, Inaugural Speech to the other players who are now assuming the role of the "constituents". All other spectators watching the game played and participating in voting are called "honorary constituents". For convenience hereafter, on any turn of a game, a player whose turn it is will be referred to as the current president, and the other players will be referred to as the constituents. The First President who at this time is now defined as the current president, now waits for each of the constituents and honorary constituents to use their paddles 310 to vote either yea 310.*a*, or duck310.*b*. The votes are tallied as described in the afore mentioned Voting Key Section 490 of the President's Personal Log 400 detailed description of the preferred embodiment of accompanying literature and also logged as an approval Rating Score, AR 481, on the current president President's Personal Log 400. The President Personal Log 400 hereafter is referred to as the PPL. Logging scores in the PPL 400, concludes the current president's turn.

From hereafter, the current president then in turn with the other players take turns rolling the two dice 730 in a clockwise rotation according to their seating around the game board 100, and moving the number of spaces reflected on the total of the two dice 730. Next the current president reads the indicia on the space which will either instruct the current president directly or may refer the current president to pick from a plurality of decks of a plurality of cards 300 with the same matching indicia as the space102, to receive further instructions. In either case, the current president must proffer a response to the card 300 or the space 102 which may or may not 1) prompts the constituents and honorary constituents to vote thus producing an AR value 481 to be recorded in the current president's PPL 400; 2) cause a change in the Federal Budget 450 and or Number of people Unemployed 460, information of which to be logged in to the PPL 400 3) or add or deduct or alter a War entry [501-507] on the War Sheet 500. In the case when a Card 300*e* instructs a player to have the player in possession of the leader token 720 to assist by role playing the leader of a foreign country, then after the role play is complete the leader token 720 is passed to the person on the left and remains until assisted role play is again necessary. In conclusion to a player's turn, all cards except the "Platform Program" cards 300*b* must be returned to the bottom of the deck from which it came. The Platform Program card 300*b* remains in the possession with the player that pulled it for the duration of the game.

The movement track 102, comprises of a total of 144 spaces. Each space bears one of thirteen unique indicia 102.1 [*a-m*], Twelve of which either randomly repeat or methodically repeat throughout the movement track 102. Thus as noted above, the indicia labeled Inaugural Address 102.1*a* is the first space and only appears once on the board's playing surface 100.*a*.

The preferred method for the remaining twelve unique indicia on the spaces are as follows; Policy Making 102.1*b* when a current president lands on Policy Making102.1*b* the current president chooses one of two options. Option one, the current president may choose to exit a war if they are currently in war and if current president is eligible to exit war. A current president exits war by turning in one or more War Chips 76 that have expired and adding troops back into the Number Available for War 503 on War Sheet 500. Option two, the current president may decide to choose a Platform Program 300*b* from the Platform Program Box 772, that matches one of the current president's three chosen platform subjects [411-416], from the current president PPL 400. Upon current presidents choosing a Platform Program 300*b*, the current president logs the jobs 461 and Approval Rating 481 directly on the players PPL 400, and then the player refers to the Oval Office 200 after the time, needed to develop program has been factored by adding it to the current time according to the position of the current president's pawn 740. Additionally the current president aligns the windows 211 and 212 of the Oval Office 200 which corresponds to the Consecutive Payments Scale 213, the Payment Frequency 211*a*, and the exact quarter of the year which is color coded to match the movement track 102, in order to retrieve the amount the gross yields 212*c* of the Platform Program 300*b*. Lastly the current president deduct the cost of the program from the gross yield 212*c* of the Platform Program 300*b* amount and log this amount into the Federal Budget Section 452 of the PPL 400. The current president keeps his Platform Program card 300*b* for the duration of the game.

2 of 12 Vacation 102.1*c*: The current president does nothing but reflect and rest in that spot until the current president's next turn.

3 of 12 Deduct Pork 102.1*d*: The current president refers to Chief of Staff player to receive assigned pork item 912. The first available pork item 912 on the Pork List 900, of which the current president must subtract from the federal budget section 452 of the PPL 400 the amount representing that pork. Thus the Deduct Pork 102.1*d* scenario is considered good for the Federal Budget 450. The Approval Rating value 481, attached to the Pork line item 912 is therefore added to the AR section 480 of the PPL 400 which is also good because the AR score 482 is higher.

4 of 12 Foreign Affairs 102.1*e*: the current president pulls a card from the plurality of cards 300*e* with the matching indicia from the place setting 103*e* on the board's playing surface 100.*a*. The current President reads the card, and determines if the FARP 600 is needed briefly for information and then proceeds to respond to scenario explained in card. The constituents and honorary constituents then vote on the performance of the current president and the AR value 480 is tallied according described in the afore mentioned detailed description of Voting and repeated also in the Voting Key section 490 provided on the PPL 400. The card 300*e* is returned back to the bottom of the its deck on the FA place setting 103*e* on the board's playing surface 100.*a*.

5 of 12 Submit 10/20/30 Bills to Congress 102.1*f*: The current president take the Party Information section 440 of the PPL 400 and plug it into the table 250 provided on the Oval Office 200 to determine the exact AR value 481 to add to the Approval Rating section 480 of the PPL 400.

6 of 12 Domestic Affairs 102.1*g*: The current president pulls a card from the plurality of cards 300*g*, with the matching indicia from the place setting 103*g* of the same matching indicia 102.1*g*, on the board's playing surface 100.*a*. The current president reads the card, and proffers a response to the scenario explained in the card. The constituents and honorary constituents then vote on the performance of the current president. The AR value 481, is tallied according to the Voting Key Section 490 on the PPL 400 which was also detailed in the afore mentioned detailed description of the preferred embodiment. The DA card 300*g*, is returned to the bottom of its deck on the DA place setting 103*g*, on the board's playing surface 100.*a*.

7 of 12 Media Frenzy 102.1*h*: The current president pulls a card from the deck of plurality of cards 300*h*, with matching indicia from the place setting 103*h*, on the board's playing surface 100.*a*. The current president reads the card 300*h*, and proffers a response to the scenario explained in the card 300*h*.*b*1. The constituents and honorary constituents then vote on the performance of the current president. The AR value 481, is tallied according to the Voting Key Section 490 of the PPL 400 which was also detailed in the afore mentioned detailed description of the preferred embodiment. The MF card 300*h*, is returned to the bottom of its deck on the MF place setting 103*h*, on the board's playing surface 100.*a*.

8 of 12 WAR 102.11: The current president pulls a card from the deck of plurality of cards 300*i*, with matching indicia from the place setting 103*i*, on the playing surface 100.*a*. The current president then logs the information onto the War Sheet 500. Specifically the current president logs the number of troops deployed for War 502, The Remaining Troops Available for Service 507, the opposing Country or group 504, and the Duration of the War 505. Then the current president refers to the player acting as Secretary of Defense to receive the War Chip 76 which corresponds to the time period matching the end of the Duration of the War 505. The current president's turn is concluded by returning the War card 300*i*, to the bottom of its deck, on the War place setting 103*i*, of the board's playing surface 100.*a*.

9 of 12 Add Pork 102.1*j*: The current president refers to Chief of Staff player to receive assigned pork item 912. The first available pork item on the Pork List 900, of which the current president must added to the federal budget section 450 of the PPL 400 the amount representing that pork. Thus adding Pork is considered bad for the Federal Budget 453. The Approval Rating value 481, attached to the Pork line item 911 is therefore subtracted from the AR section 480 of the PPL 400, which is also considered bad for the AR score 482 because the action taken makes the AR score 482 lower.

10 of 12 Press Conference 102.1*k*: The constituents and honorary constituents become reporters assigned to the White House. The current president starts a time piece 752, for 60 seconds and immediately and randomly select from the reporters to ask the current president a random "presidential question". At this point he current president may choose to answer the question or decline to answer and as long as there is still time on the time piece 752 the current president can solicit another question to answer. At the end of the 60 seconds the reporters must use the voting paddles 310 to vote on the performance of the current president according to the details of voting in the afore mentioned detailed description of the preferred embodiment however the final outcomes of the voting 490 are doubled because reporters are members of the Press core which has a heavier influence on public opinion. Thus the final votes are more specifically defined as follows; a current president receives the highest score of eight points if reporters unanimously approve 491 the current president's performance. Likewise a current president receives the lowest possible score minus eight points if reporters unanimously disapprove 495 the current president' performance. Similarly the current president receives the second highest score of 6 points if the majority of reporters approve 492. Likewise the current president receives the second lowest score of two points if the majority of the reporters disapprove 494 and four points if the reporters are tied 493.

11 of 12 Appoint Judge to Supreme Court 102.1*l*: The current president responds by giving a brief 30 second 751 explanation of why the current president chose a particular judge. The constituents and honorary constituents then vote on the performance of the current president. The AR value 481, is tallied according to the Voting Key Section 490 of the PPL 400 which was also detailed in the afore mentioned detailed description of the preferred embodiment.

12 of 12 The State of the Union Address 102.1*m*: The current president takes 60 seconds 752 to give a speech addressing the American people with the option of drawing upon all the data collected on the PPL 400, knowledge gained from other interactions during the game and the current president's personal political knowledge. The conclusion of the current president's response prompts a vote on the current president's performance from the constituents and honorary constituents using the voting paddles 310. An AR value 481, is tallied according to the Voting Key Section 490 of the PPL 400 which was also detailed in the afore mentioned detailed description of the preferred embodiment.

After all the players have reached and completed the final space, State Of The Union Address 102.1*m*, of the $4^{th}$ year of their presidency 102*d*, players must calculate their Final Score 499, which is mapped out at the bottom of the PPL 400. First the player calculates and plugs in the Final Federal Budget, Final FB 454, as spelled out on the PPL 400 into the Final FB 454 box. Then if the pre-filled Inherited FB 455, is a surplus add the Inherited FB 455, to your Final FB 454, to produce your Net FB 456. However if the pre-filled Inherited FB 455 is a deficit then deduct the Inherited FB 455, from the Final FB 454, to produce the Net FB 456.

Likewise and first the Final AR is acquired by deducting 15 (fifteen) points for each active war otherwise known as the War Deduction 483*a* from the Sub-total AR 483 as described in the afore mentioned detailed description of the preferred embodiment. Then the Net AR 486 is achieved by deducting the Inherited AR 485 from the Final AR 484.

Finally to obtain the Final Score 499, the Net FB 456 is added to the Net AR 486. The Winner of the present invention game is the player with the highest Final Score 499.

Periodically, the interne is used by players as an updating tool to retrieve new scenario cards based of the latest current events.

APPENDIX A

President Game Ingredient and ID Log 840

| FIG. # | Id number | Item |
|---|---|---|
| 1A | 100 | Game BOARD |
| 1A | 100.a | Board playing surface |
| | 101 | titile |
| | 102 | track |
| | 102a | Arch 1/Year One RED |
| | 102b | Arch 2/Year Two WHITE |
| | 102c | Arch 3/Year Three NAVY |
| | 102d | Arch 4/Year Four BLACK |
| | 102.10 | Spaces |
| | 102.11 | Start Here |
| | 102.1a | Inaugural address |
| | 102.1b | Policy Making |
| | 102.1c | Vacation |
| | 102.1d | Deduct Pork |
| | 102.1e | FA |
| | 102.1f | Submit . . . Congress |
| | 102.1g | DA |
| | 102.1h | MF |
| | 102.1i | War |
| | 102.1j | Add Pork |
| | 102.1k | Press Conference |
| | 102.1l | Appoint Judge |
| | 102.1m | State of the Union |
| | 102.1z | Re-election or New administration |
| | 103 | Place Settings |
| | 103e | FA |
| | 103g | DA |
| | 103h | MF |
| | 103i | War |
| | 106 | Time Markings |
| | 106.01 | 3 months or Quarter One |
| | 106.02 | 6 months or Quarter Two |
| | 106.03 | 9 months or Quarter Three |
| | 106.04 | 12 months or Quarter Four |
| 2A | 200 | OVAL OFFICE |
| 2A, 2C | 210 | President seal top circular panel |
| 2A | 211 | window 1 for viewing payment frequency |
| | 211a | empirical data $a_1$ or $a_2$ revealed through window 211 |
| | 212 | window 2 for viewing total consecutive payments |
| | 212c | empirical data $c_1$ or $c_2$ revealed through window 212 |
| | 213 | Consecutive Payment Scale |
| 2B | 230 | Bottom Oval shaped panel with circular inlay |
| | 230R1 | RED year1-Qtr1 |
| | 230R2 | RED year1-Qtr2 |
| | 230R3 | RED year1-Qtr3 |
| | 230R4 | RED year1-Qtr4 |
| | 230W1 | WHITE year2-Qtr1 |
| | 230W2 | WHITE year2-Qtr2 |
| | 230W3 | WHITE year2-Qtr3 |
| | 230W4 | WHITE year2-Qtr4 |
| | 230N1 | NAVY year3-Qtr1 |
| | 230N2 | NAVY year3-Qtr2 |
| | 230N3 | NAVY year3-Qtr3 |
| | 230N4 | NAVY year3-Qtr4 |
| | 230B1 | BLACK year4-Qtr1 |
| | 230B2 | BLACK year4-Qtr2 |
| | 230B3 | BLACK year4-Qtr3 |
| | 230B4 | BLACK year4-Qtr4 |
| | $a_1$ | payment frequency option 1 |
| | $a_2$ | payment frequency option 2 |
| | $c_1$ | total consecutive payments viewed through 212 for $a_1$ |
| | $c_2$ | total consecutive payments viewed through 212 for $a_2$ |

APPENDIX A-continued

President Game Ingredient and ID Log 840

| FIG. # | Id number | Item |
|---|---|---|
| 2A | 225 | vertex (center) |
| 2A | 250 | Table |
| | 251 | Number of bills Submitted to Congress |
| | 252 | Percentage of Bills Passed to Law |
| | 253 | number of bills passed to law |
| 5.1 | 300 | Cards |
| | 300.a or 300(b/e/f/g/h/l).a | front side of card |
| | 300.a1 or 300(b/e/f/g/h/l).a1 | Trademark and Subject Indicia |
| | 300.a2 or 300(b/e/f/g/h/l).a2 | card title |
| | 300.a3 or 300(b/e/f/g/h/l).a3 | card border |
| | 300.a3 or 300(b/e/f/g/h/l).a4 | card border |
| 5.2a | 300.b or 300(e/g/h).b | reverse side of card |
| | 300.b1 or 300(e/g/h).b1 | political scenario |
| | 300.b2 or 300(e/g/h).b2 | unique card identification number |
| | 300.b3 or 300(e/g/h).b3 | game edition and series |
| | 300.b4 or 300(e/g/h).b4 | subjective question |
| 5.2d | 300i.b | War card reverse side |
| | 300i.b1 | US versus: |
| | 300i.b2 | Cause of War |
| | 300i.b3 | Projected Cost |
| | 300i.b4 | Number of Troops deployed |
| | 300i.b5 | Expected war duration |
| | 300i.b6 | Identification # |
| | 300i.b7 | Approval Rating Value (AR) |
| 5.2c | 300f.b | Reverse side of Party Ratio card |
| | 300f.b1 | unique card identification number |
| | 300f.b2 | Senate Ratio |
| | 300f.b3 | House of Represenative Ratio |
| | 300f.b4 | Total Giraffe ratio in both Senate and House of Reps. |
| | 300f.b5 | Total Hippo ratio in both Senate and House of Reps. |
| | 300f.b6 | Card Title |
| 5.2b | 300b.b | Reverse side of Platform Program card |
| | 300b.b1 | unique card identification number |
| | 300b.b2 | Platform Subject |
| | 300b.b3 | Specific Platform Program |
| | 300b.b4 | Cost of Program |
| | 300b.b5 | Number of Jobs created |
| | 300b.b6 | Time needed to develop |
| | 300b.b7 | Consecutive Payouts |
| | 300b.b8 | Payout Frequency |
| | 300b.b9 | Approval Rating Value (AR) |
| 6 | 310 | Voting Paddle |
| 6.1 | 310.a | side a: Approval vote |
| | 310.a1 | proposed trademark fist bump illustration |
| | 310.a2 | illustration title |
| | 310.a3 | game title |
| 6.2 | 310.b | side b: disapproval vote |
| | 310.b1 | proposed trademark duck/shoe illustration |
| | 310.b2 | illustration title |
| | 310.b3 | game title |
| 3A | 710 | political party buttons |
| | 711 | giraffe |
| | 712 | hippo |
| 3B | 720.a | leader token front side |
| | 720.b | reverse side of leader token |
| | 730 | two dice |

APPENDIX A-continued

President Game Ingredient and ID Log 840

| FIG. # | Id number | Item |
|---|---|---|
| 4 | 740 | pawn |
| | 741 | Airforce One |
| | 742 | limousine |
| | 743 | eagle |
| | 744 | donkey |
| | 745 | hummer |
| | 746 | helicopter |
| | 747 | liner |
| 4 | 748 | submarine |
| | 750 | hour glass |
| | 751 | 30 second |
| | 752 | 60 second |
| | 753 | 90 second |
| 3C | 76 | WAR CHIPS |
| | 76R1 | year1-Qtr1 |
| | 76R2 | year1-Qtr2 |
| | 76R3 | year1-Qtr3 |
| | 76R4 | year1-Qtr4 |
| | 76W1 | year2-Qtr1 |
| | 76W2 | year2-Qtr2 |
| | 76W3 | year2-Qtr3 |
| | 76W4 | year2-Qtr4 |
| | 76N1 | year3-Qtr1 |
| | 76N2 | year3-Qtr2 |
| | 76N3 | year3-Qtr3 |
| | 76N4 | year3-Qtr4 |
| | 76B1 | year4-Qtr1 |
| | 76B2 | year4-Qtr2 |
| | 76B3 | year4-Qtr3 |
| 3C | 76B4 | year4-Qtr4 |
| | 770 | Boxes |
| | 771.a | Game box Top Cover |
| | 771.b | Game box Bottom cover |
| | 772 | platform card interior box |
| 7 | | LITERATURE |
| 7A | 400 | President's Personal Log |
| | 410 | Platform Subjects |
| | 411 | Alternative Energy |
| | 412 | Education Reform |
| | 413 | Increase Employment |
| | 414 | Elimate Homelessness |
| | 415 | Health Care Reform |
| | 416 | Tax Reform |
| | 420 | Your Campaign Platforms |
| | 430 | President's Inheritance |
| | 430.1 | OBAMA |
| | 430.2 | BUSH |
| | 430.3 | CLINTON |
| | 430.4 | REAGAN |
| | 430.5 | CARTER |
| | 435 | Economy |
| | 440 | Party Information |
| | 441 | Giraffe OR Hippo |
| | 445 | Bills Passed to Law Ratio Percentages |
| | 446 | Giraffe |
| | 447 | Hippo |
| | 450 | Federal Budget Log |
| | 451 | Card # or Item # |
| | 452 | Change in Federal Budget |
| | 453 | New Balance |
| | 460 | Jobs |
| | 461 | Change in Jobs |
| | 462 | Unemployed |
| | 470 | Platform |
| | 471 | Platform Subject # |
| | 480 | Approval Rating |
| | 481 | AR Change |
| | 482 | New AR |
| | 490 | VOTING KEY |
| | 491 | Unanimous Yea |
| | 492 | Majority Yea |
| | 493 | Tie |
| | 494 | Majority Duck |
| | 495 | Unanimous Duck |
| | 496 | Calculations |
| | 454 | FINAL FB |

APPENDIX A-continued

President Game Ingredient and ID Log 840

| FIG. # | Id number | Item |
|---|---|---|
| | 455 | INHERITED FB |
| | 456 | NET FB |
| | 483 | SUBTOTAL AR |
| | 483a | WAR DEDUCTION |
| | 484 | FINAL AR |
| | 485 | INHERITED AR |
| | 486 | NET AR |
| | 499 | FINAL SCORE |
| 7B | 500 | WAR SHEET |
| | 501 | unique card identification number |
| | 502 | number of Troops deployed |
| | 503 | remaining Troops available for service |
| | 504 | Opposing country or group |
| | 505 | Duration of War |
| | 506 | Check if eligible to exit war |
| | 507 | Total Number of Troops fit for service |
| 7C | 600 | FARP |
| | 601 | Country |
| | 602 | Leader |
| | 603 | Location |
| | 611 | Capital |
| | 612 | Languages |
| | 604 | GDP |
| | 605 | Population |
| | 606 | Religion |
| | 607 | Currency |
| | 608 | Exchange Rate |
| | 609 | Imports/Partnerships |
| | 610 | Exports/Partnerships |
| | 620 | Military |
| | 640 | Nuclear Defense Facts |
| | 650 | Alternative Energy Facts |
| 7D | 900 | The PRESIDENT'S PORK LIST |
| | 910 | Player |
| | 911 | Pork # |
| | 912 | Pork Description |
| | 913 | AR Value |
| | 914 | Federal Budget Impact |
| APPENDIX A | | PRESIDENT game INGREDIENT CATALOG |

The invention claimed is:

1. A current affair political apparatus for entertaining comprising:

(a) a game board which includes a movement track divided into four colors wherein each color represents one year of a four year presidential term and each year is subdivided into a plurality of spaces bearing indicia to reflect a plurality of categories of political subjects;

(b) a plurality of decks of a plurality of scenario cards with the front side bearing indicia to match the indicia of at least one of the said spaces on the said game board;

(c) a deck of a plurality of cards with the front side bearing indicia to match the indicia bearing at least one place setting on the said game board;

(d) a deck of a plurality of Voting Paddles comprising the front side representing affirmation and the back side representing rejection;

(e) Political Party Pin-back Buttons bearing indicia of one of either two political parties;

(f) a simulation of an official source wherein players retrieve talking points, referred to as Foreign Affairs Reference Manual, comprising statistics and notes on a plurality of countries, and a plurality of Alternative Energy Sources;

(g) one of a plurality of score sheets referred to as the President's Personal Log comprising any combination of the following: Approval Rating log, Federal Budget log, Unemployment statistics, War Involvement, Party Makeup in Congress, a bills submitted to Congress chart, and a Voting Key;

(h) a leader coin bearing indicia on both sides representing the Hippo and the Giraffe political party;

(i) a plurality of place markers also referred to as pawns comprising at least one or any of the combinations Air Force One Jet, Limousine, Helicopter, Hummer, Tank, Submarine, Cruise Liner, Eagle, and Donkey;

(j) a plurality of War chips;

(k) a sixty-second and a thirty second sand timer;

(l) and two dice;

(m) an oval office device comprises:

1) a base unit comprising:

A) a firm oval shaped panel made from non flexible material, wherein said oval shaped panel bears the indicia of an overlapping inlayed inner circle and a larger outer circle wherein both said circles share common center with said oval panel, wherein said outer circle further comprises:

i. a diameter equal to width of said oval panel and, ii. a circumference bearing indicia representing time corresponding to player's marker position on said movement track, wherein said inner circle further comprises:

i. four pie shaped quarters, wherein each said quarters are divided into four smaller equal pie sections colored to match the colors on the said movement track and, ii. indicia on each said smaller pie section bearing frequency rates that payments are made and aggregate dollar amounts paid during players' administrative terms, B) indicia on either lengthwise end of said oval panel bearing a ten column by four row table wherein the said table is populated with numerical information representing quantities of players' legislation passed into law;

2) an upper radial piece comprising:

A) two rectangular slots, through which information on underneath said oval panel may be seen;

B) a diameter length the same as diameter of said inlayed inner circle of said oval panel;

C) a center that overlaps and intersects the center of said oval panel wherein circumference area of said larger inlayed outer circle of said oval panel is exposed;

D) attachment device positioned at point of intersection (both centers), of the said oval panel and said upper radial piece wherein said upper radial piece rotates;

E) indicia bearing single payment amount information corresponding to a plurality of scenario cards and;

F) indicia bearing emblems representing political theme of the game board;

(n) the assumption that each player is the President of their very own country of The United States of America;

(o) the said President's Personal Log allows said player to track the progress of their administration during their term.

2. The apparatus according to claim 1 wherein the said game board comprises at least one or any combination of:

a. a starting space;

b. an ending space, such that when reached by all the players the final scores are tallied for a winner;

c. an Inaugural Address space, such that when reached is associated with a specific set of instructions regarding addressing the citizens of the United States;

d. at least one Foreign Affair space, such that is associated with a deck of a plurality of scenario cards bearing indicia that matches the indicia of said Foreign Affair space;

e. at least one Domestic Affair space, such that is associated with a deck of a plurality of scenario cards bearing indicia that matches the indicia of said Domestic Affair space;

f. at least one Media Frenzy space, such that is associated with a deck of a plurality of scenario cards bearing indicia that matches the indicia of said Media Frenzy space;

g. at least one Rebuttal space, such that is associated with specific instructions and a deck of a plurality of cards bearing indicia that matches the indicia of said Rebuttal space;

h. at least one Submit 10Bills space, such that when reached is associated with specific instructions regarding the number of bills passed to law by Congress;

i. at least one Submit 20Bills space, such that when reached is associated with specific instructions regarding the number of bills passed to law by Congress;

j. at least one Submit 30 Bills space, such that when reached is associated with specific instructions regarding the number of bills passed to law by Congress;

k. at least one Appoint Judge space, such that when reached is associated with specific instructions regarding the merits of player's Supreme Court Justice choice;

l. at least one Press Conference space, such that when reached is associated with specific instructions regarding an open forum for players to receive questions;

m. at least one State Of The Union space, such that when reached is associated with specific instructions regarding addressing the citizens of the United States;

n. a plurality of place settings bearing indicia to match the front sides of at least one of the plurality of decks of cards bearing indicia that matches the said place settings.

3. The apparatus according to claim 1 where in said plurality of score sheets, President's Personal Log, comprises a plurality of US President inheritances which further comprises all pre-filled Approval Rating entries, pre-filled Federal Budget entries, pre-filled Unemployment entries and pre-filled War entries.

4. The apparatus according to claim 1 wherein an object of the game is to make decisions on current affair issues as the US President that will have a positively measurable affect on Approval Rating, Federal Budget, Unemployment and War.

5. The apparatus according to claim 1 wherein a further object is to achieve the highest said Approval Rating after having made a plurality of presidential decisions based on current affairs.

6. The said plurality of decks of a plurality of scenario cards in claim 1 comprises of the front sides bearing indicia to reflect either one of each of the following subjects: Foreign Affair or FA, Domestic Affair or DA, Media Frenzy or MF, and Rebuttal.

7. The said Rebuttal cards of claim 1 wherein associated with players protesting proffered responses of players whose turn is to be the President.

8. The said decks of a plurality of cards bearing indicia to match the game board of claim 1 comprises the category Party Ratio.

9. Said leader coin of claim 1 is for appointments to serve as leaders of other countries and high office appointments and leadership.

10. The said War chips of claim 1 provides a visual representation of a player's involvement in War.

11. The color correlation between the said War chips and said movement track of claim 1 wherein the same colors represents the same specific year of the color as of said colored movement track.

12. The color correlation between the oval office and said movement tract of claim 1 wherein the same colors represent the same specific year of the color as of said colored movement track.

* * * * *